US008888089B1

(12) United States Patent
Motoyama

(10) Patent No.: US 8,888,089 B1
(45) Date of Patent: Nov. 18, 2014

(54) SHEET CONVEYING DEVICE AND IMAGE PROCESSING APPARATUS

(71) Applicant: Toshiki Motoyama, Konan (JP)

(72) Inventor: Toshiki Motoyama, Konan (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/092,222

(22) Filed: Nov. 27, 2013

(30) Foreign Application Priority Data

Dec. 3, 2012 (JP) ..... 2012-264570

(51) Int. Cl.

| | |
|---|---|
| ***B65H 3/44*** | (2006.01) |
| ***B65H 5/26*** | (2006.01) |
| ***B65H 7/20*** | (2006.01) |
| ***B65H 7/02*** | (2006.01) |

(52) U.S. Cl.

CPC .. *B65H 7/20* (2013.01); *B65H 5/26* (2013.01); *B65H 7/02* (2013.01)

USPC . 271/9.01; 271/4.02; 271/10.02; 271/265.01; 271/8.1

(58) Field of Classification Search

USPC ..... 271/4.02, 10.02, 8.1, 9.01, 265.01

See application file for complete search history.

(56) References Cited

U.S. PATENT DOCUMENTS

2011/0222948 A1* 9/2011 Asada et al. ..... 400/611

FOREIGN PATENT DOCUMENTS

JP 2012-184057 9/2012

* cited by examiner

*Primary Examiner* — Prasad Gokhale

(74) *Attorney, Agent, or Firm* — Merchant & Gould PC

(57) ABSTRACT

A sheet conveying device includes: a conveyer configured to convey a sheet; a first introducing part into which a sheet is introduced toward the conveyer; a second introducing part into which a sheet is introduced toward the conveyer, wherein the second introducing part is different from the first introducing part; a cover configured to be displaced between an open state, in which the second introducing part is opened, and a closed state, in which the second introducing part is covered, in a state where the first introducing part is opened; a cover sensor that detects the open-and-closed state of the cover; and a controller, wherein when the cover sensor detects the closed state of the cover, the controller performs a driving process of driving the conveyer.

12 Claims, 13 Drawing Sheets

SHEET CONVEYING DEVICE AND IMAGE PROCESSING APPARATUS

CROSS-REFERENCE TO RELATED APPLICATION

This application claims priority from Japanese Patent Application No. 2012-264570 filed on Dec. 3, 2012, the entire subject matter of which is incorporated herein by reference.

TECHNICAL FIELD

This disclosure relates to a sheet conveying device, and specifically, to a technology of suppressing a collision between sheets in a sheet conveying device having two introducing parts to introduce the sheets.

BACKGROUND

There is an example of a technology of suppressing a collision between sheets in a sheet conveying device having two introducing parts to introduce sheets. The technology discloses that two sensors for detecting sheets introduced from two introducing parts are provided for the introducing parts, respectively, and when both of the sensors detect sheets, since it is determined that a jam will occur due to a collision between the sheets introduced from the introducing parts, conveyance of the sheets is restricted.

SUMMARY

However, in a state where it is always possible to introduce sheets into the introducing parts, the frequency of restriction of conveying sheets will increase, and convenience will be reduced.

This disclosure provide at least a technology of maintaining convenience while suppressing inconvenience due to simultaneous conveyance of a plurality of sheets in a configuration having two introducing parts to introduce sheets.

A sheet conveying device comprises: a conveyer configured to convey a sheet; a first introducing part into which a sheet is introduced toward the conveyer; a second introducing part into which a sheet is introduced toward the conveyer, wherein the second introducing part is different from the first introducing part; a cover configured to be displaced between an open state, in which the second introducing part is opened, and a closed state, in which the second introducing part is covered, in a state where the first introducing part is opened; a cover sensor that detects the open-and-closed state of the cover; and a controller, wherein when the cover sensor detects the closed state of the cover, the controller performs a driving process of driving the conveyer.

According to this configuration, in a state where the cover is open, it is possible to convey only a sheet introduced in the first introducing part which is in the open state. Accordingly, it is possible to avoid a state where it is always possible to introduce sheets into the individual introducing parts, and it is possible to reduce the frequency of restriction of sheet conveyance. Therefore, in a configuration having two introducing parts, it is possible to maintain convenience while suppressing inconvenience due to simultaneous conveyance of a plurality of sheets.

According to this disclosure, in the configuration having two introducing parts to introduce sheets, since the conveyer for conveying a sheet is driven when the cover sensor detects the closed state of the cover, it is possible to maintain convenience while suppressing inconvenience due to simultaneous conveyance of a plurality of sheets.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Illustrative Embodiment

Hereinafter, an illustrative embodiment of this disclosure will be described with reference to FIGS. 1 to 12.

1. Overall Configuration of Image Reading Apparatus

Figure 1:
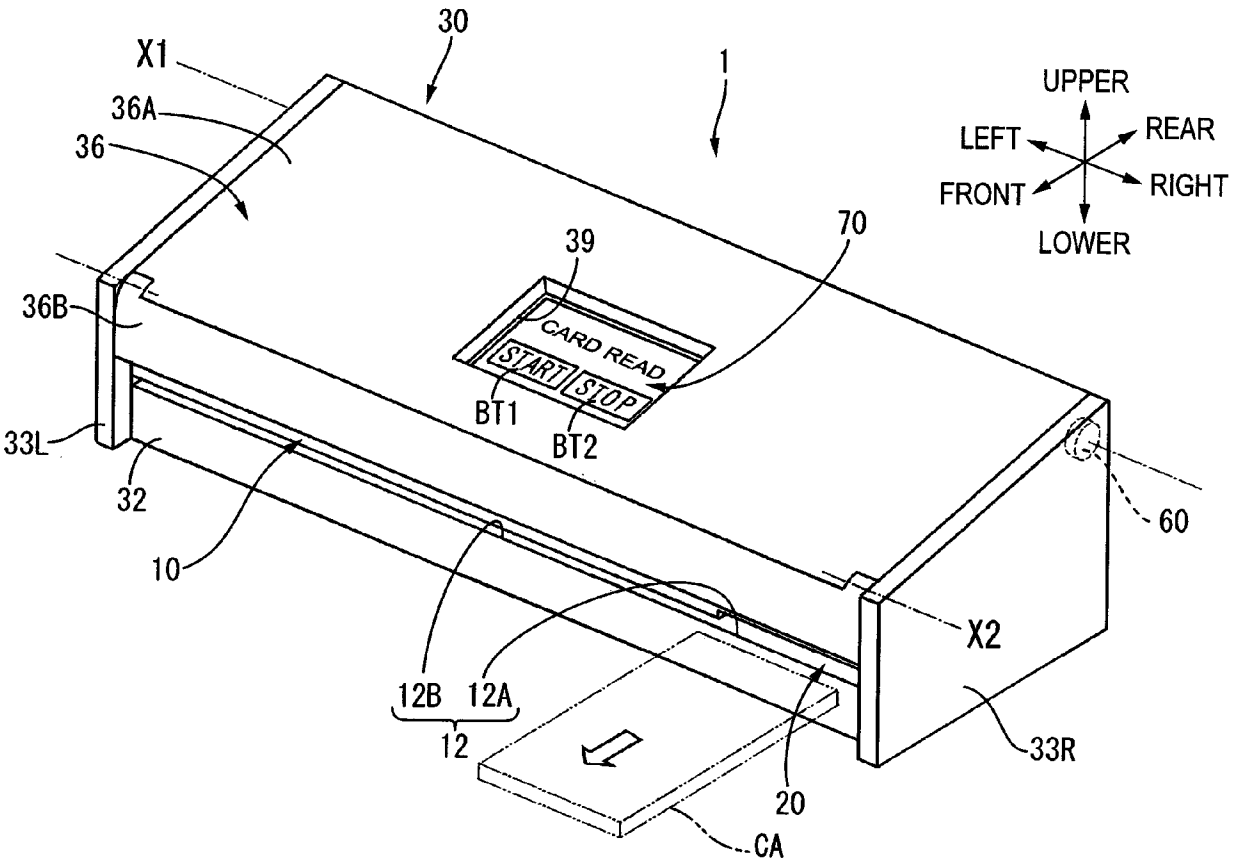
FIG. 1 is a perspective view illustrating the front side of an image reading apparatus according to an illustrative embodiment of this disclosure.

First, the overall configuration of an image reading apparatus 1 will be described with reference to FIGS. 1 to 7. The image reading apparatus 1 is an example of an image processing apparatus having a sheet conveying device of this disclosure. In FIG. 1, front, rear, left, right, upper, and lower sides of the image reading apparatus are indicated. Specifically, the discharging opening (12) side is referred to as the front side of the image reading apparatus, and the left side as seen from a user facing the discharging opening 12 is referred to as the left side of the image reading apparatus. In the other drawings, all directions are indicated with reference to the directions shown in FIG. 1.

Meanwhile, the image processing apparatus having the sheet conveying device is not limited to the image reading apparatus. The image processing apparatus may be, for example, an image forming apparatus. The sheet conveying device may not be provided in an image processing apparatus and may have a function of performing coating on the surface of a sheet.

As shown in FIGS. 1 to 7, the image reading apparatus 1 includes a sheet conveying device 2, a control board 5, a housing 30, a reading unit 55, a touch panel 70, and etc.

The sheet conveying device 2 includes conveyance paths 10 and 20, introducing openings 11 and 21, a discharging opening 12, a tray cover (an example of a cover) 36, a conveyer 40, and a variety of sensors such as an open/closed position sensor 60, a document front sensor (hereinafter, referred to as a document F sensor) 61, a card front sensor (hereinafter, referred to as a card F sensor) 62, a document rear sensor (hereinafter, referred to as a document R sensor) 63, a card rear sensor (hereinafter, referred to as a card R sensor) 64.

Figure 2:
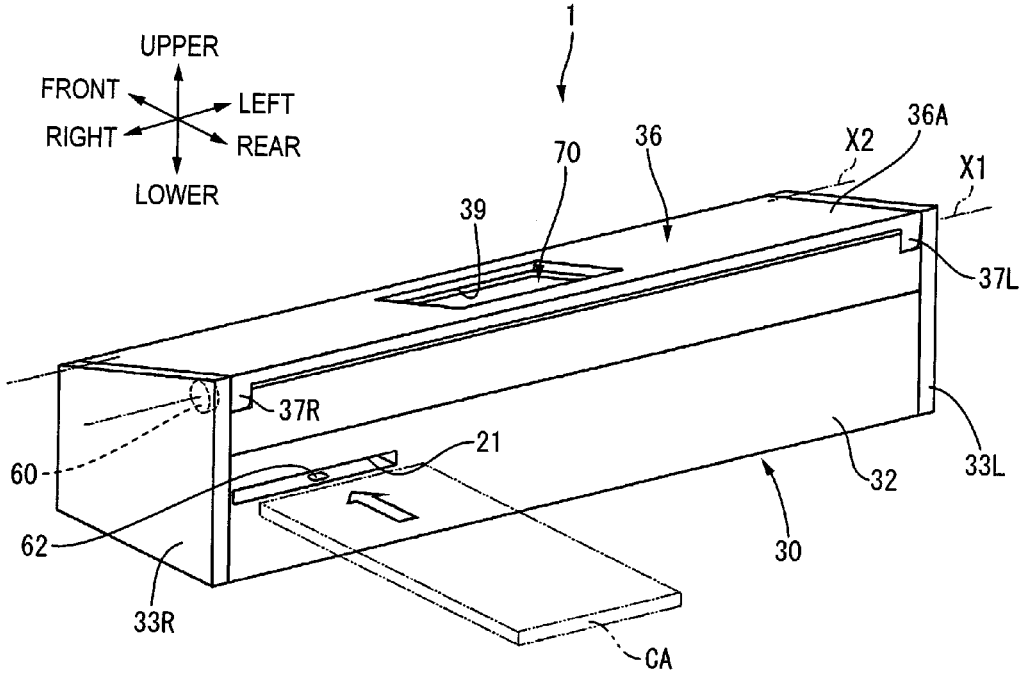
FIG. 2 is a perspective view illustrating the rear side of the image reading apparatus.

As shown in FIG. 1, FIG. 2, and so on, the housing 30 includes a first housing 31, a second housing 32, and a pair of side frames 33L and 33R. The first housing 31, which is positioned on the upper side, and the second housing 32, which is positioned on the lower side, face each other with a gap in the vertical direction. The left side frame 33L and the right side frame 33R hold the first housing 31 and the second housing 32 from the outer side in the left-right direction, with interposing therebetween.

Figure 3:
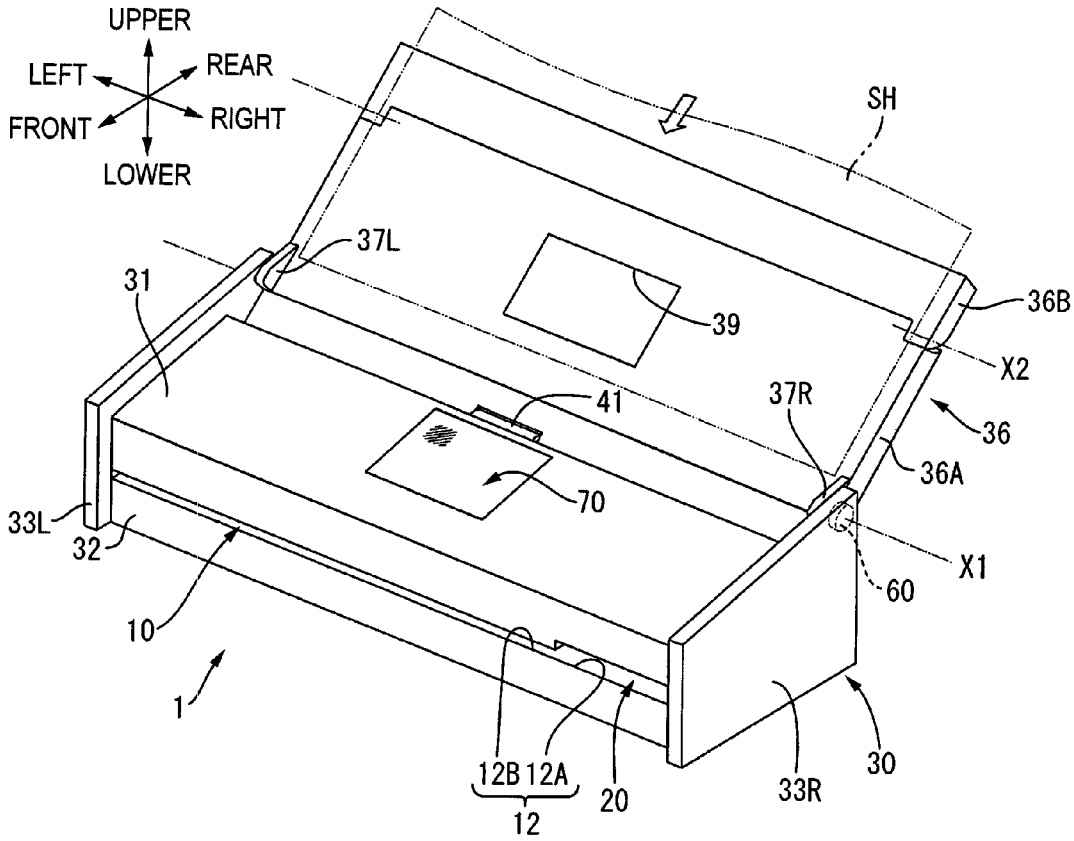
FIG. 3 is a perspective view illustrating the front side of the image reading apparatus in a state where a feeding tray is at an open position.

The introducing opening 11 is a second introducing opening 11 (an example of a second introducing part) which is to introduce a document (an example of a sheet) SH and is shown in FIG. 3 and so on. The introducing opening 21 is a first introducing opening (an example of a first introducing part) 21 which is to introduce a card (an example of the sheet) CA and is shown in FIG. 2 and so on. Here, a card CA is, for example, a membership card, a certificate, or the like made of plastic, and a document SH is, for example, a paper sheet, an OHP sheet, or the like.

The discharging opening 12 includes a first discharging opening (an example of a discharging part) 12A which is for discharging a card CA and is shown in FIG. 1 and so on, and a second discharging opening (an example of the discharging part) 12B which is for discharging a document SH and is shown in FIG. 1 and so on. The first discharging opening 12A is used even for discharging a document SH. That is, the first discharging opening 12A can be used for both of discharging of a card CA and discharging of a document SH.

Figure 5:
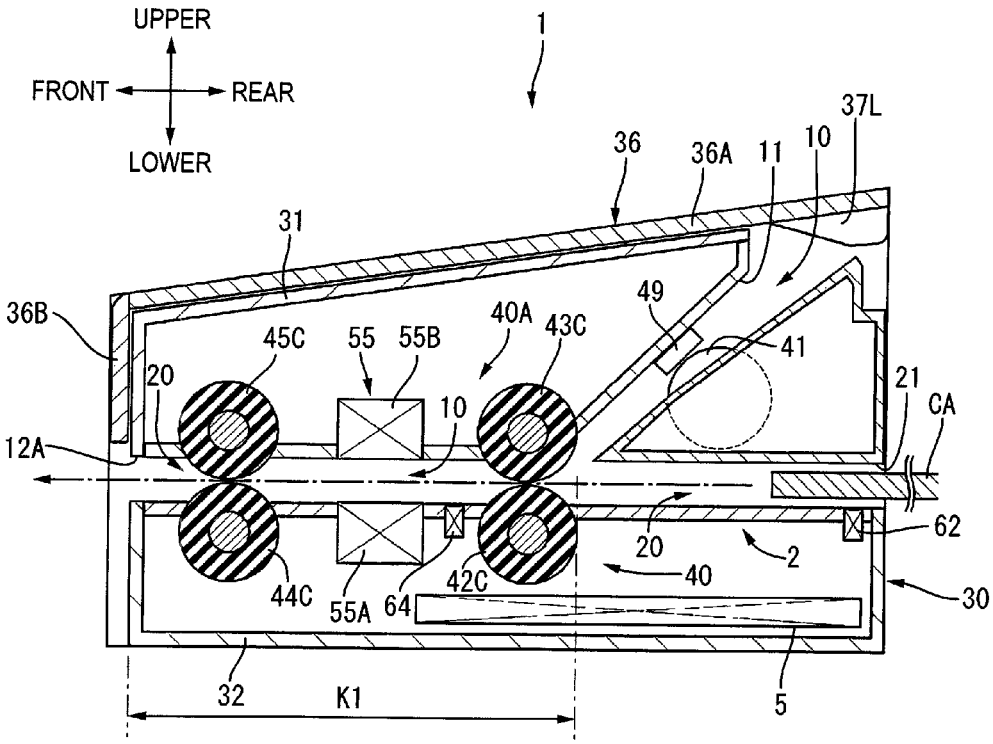
FIG. 5 is a cross-sectional view schematically illustrating a cross section taken along a line V-V of FIG. 4 and illustrating a state where the tray cover is at a closed position.
Figure 6:
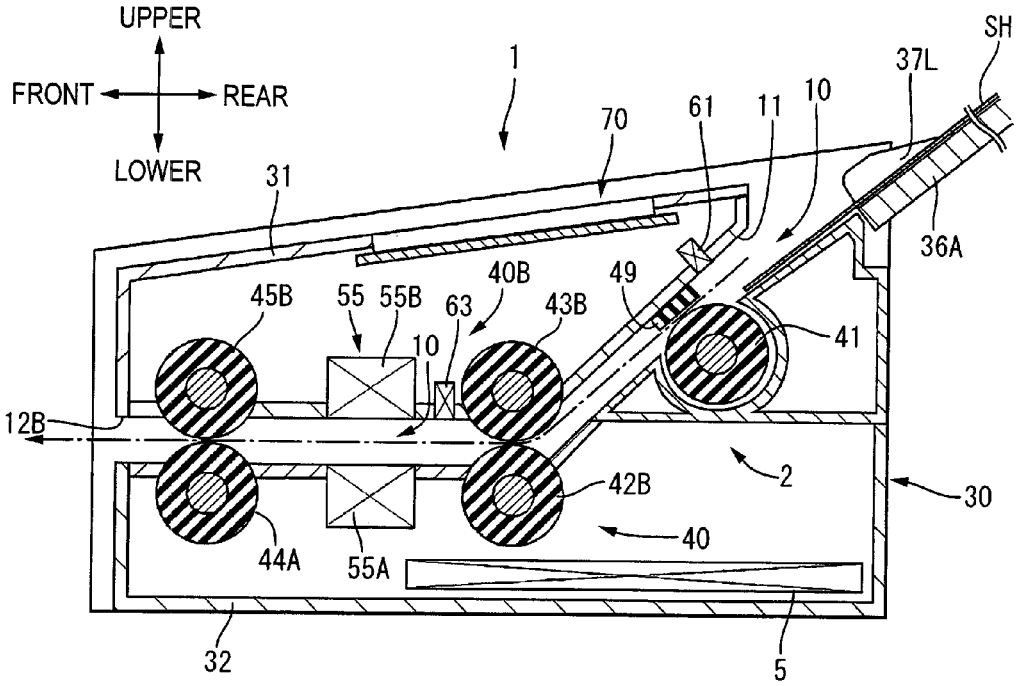
FIG. 6 is a cross-sectional view schematically illustrating a cross section taken along a line VI-VI of FIG. 4.

The conveyance path 10 is a second conveyance path 10 which coveys a document SH from the second introducing opening 11 and is shown in FIG. 6 and so on. The conveyance path 20 is a first conveyance path 20 which coveys a card CA from the first introducing opening 21 and is shown in FIG. 5 and so on. As shown in FIG. 5, the second conveyance path 10 joins the first conveyance path 20 on the way. Specifically, the left end portion of the second conveyance path 10 joins the first conveyance path 20 on the way (see FIG. 4). In other words, the first conveyance path 20 joins the second conveyance path 10 on the way (see FIG. 5). Meanwhile, the first conveyance path 20 is a conveyance path that linearly connects the first introducing opening 21 and the first discharging opening 12A, and the second conveyance path 10 is a conveyance path that is bent and connects the second introducing opening 11 and the discharging opening 12. Therefore, a card such as a plastic certificate can be used as a sheet which can be introduced from the first introducing opening 21, and a normal paper document can be used as a sheet which can be introduced from the second introducing opening 11.

The tray cover 36 includes a first tray 36A and a second tray 36B as shown in FIG. 1 and so on. The first tray 36A functions as a cover to open and close the second introducing opening 11 and also functions as a tray for mounting a document SH. A document SH mounted on the tray cover 36 is introduced into the second introducing opening 11 and is guided toward the second discharging opening 12B through the second conveyance path 10.

Here, the tray cover 36 is an example of a cover, which is displaced between an open state (see FIG. 3, FIG. 6, and so on), in which the second introducing opening 11 is opened in a state where the first introducing opening 21 is opened, and a closed state (see FIG. 2, FIG. 5, and so on), in which the second introducing opening 11 is covered in the state where the first introducing opening 21 is opened.

Figure 4:
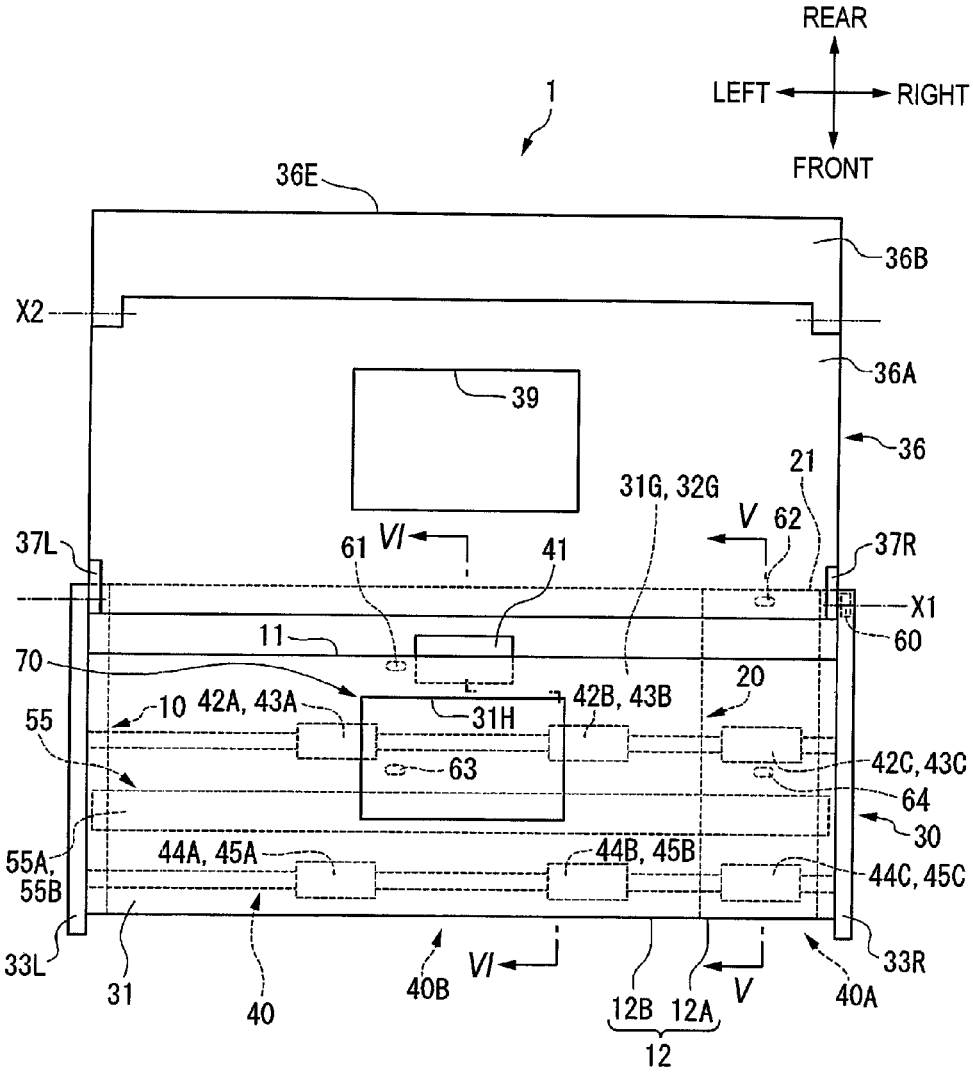
FIG. 4 is a top view illustrating the image reading apparatus in a state where a tray cover is at an open position.

As shown in FIGS. 3 and 4, at the left and right corners of the first tray 36A, a pair of hinge portions 37L and 37R is formed integrally. At the center of the first tray 36A, an operation opening 39 is formed in a rectangular shape. The first tray 36A is supported on both side frames 33L and 33R through both hinge portions 37L and 37R such that the first tray 36A is rotatable around a rotation axis X1.

The second tray 36B is connected to the left and right corners of the opposite side of the first tray 36A to both hinge portions 37L and 37R. In this way, the second tray 36B is supported on the first tray 36A such that the second tray 36B is rotatable around a rotation axis X2 extending in the left-right direction. Meanwhile, as shown in FIG. 1, the operation opening 39 exposes the touch panel 70 even when a state where the tray cover 36 is the closed state.

The conveyer 40 includes a first conveyer 40A which coveys a card CA introduced from the first introducing opening 21 and is shown in FIGS. 4 and 5, a second conveyer 40B which coveys a document SH introduced from the second introducing opening 11 and is shown in FIGS. 4 and 6, and a drive motor 80.

As shown in FIG. 4, the first conveyer 40A includes a conveying roller 42C, a discharging roller 44C, and driven rollers 43C and 45C. Meanwhile, the second conveyer 40B includes a feeding roller 41, a separating pad 49, conveying rollers 42A and 42B, discharging rollers 44A and 44B, and driven rollers 43A, 43B, 45A, and 45B.

Meanwhile, the first conveyer 40A can be used for conveying a document SH. Further, in the present illustrative embodiment, one drive motor 80 is commonly used to transmit power to the conveying roller 42C, the discharging roller 44C, the feeding roller 41, the conveying rollers 42A and 42B, and the discharging rollers 44A and 44B of the first conveyer 40A and the second conveyer 40B through a power transmission mechanism (not shown). That is, the first conveyer 40A and the second conveyer 40B are driven at the same time by the drive motor 80.

The separating pad 49 is pressed against the feeding roller 41 by a pressing member (not shown). Therefore, the separating pad 49 can cooperate with the feeding roller 41 to nip and separate a document SH to be conveyed in the second conveyance path 10, one by one. Hereinafter, in a case where it is necessary to distinguish the rollers of the conveyer 40, suffixes "A", "B", and "C" are added to their reference symbols, and in a case where it is unnecessary to distinguish them, the suffixes are omitted.

2. Electrical Configuration of Image Reading Apparatus

Figure 7:
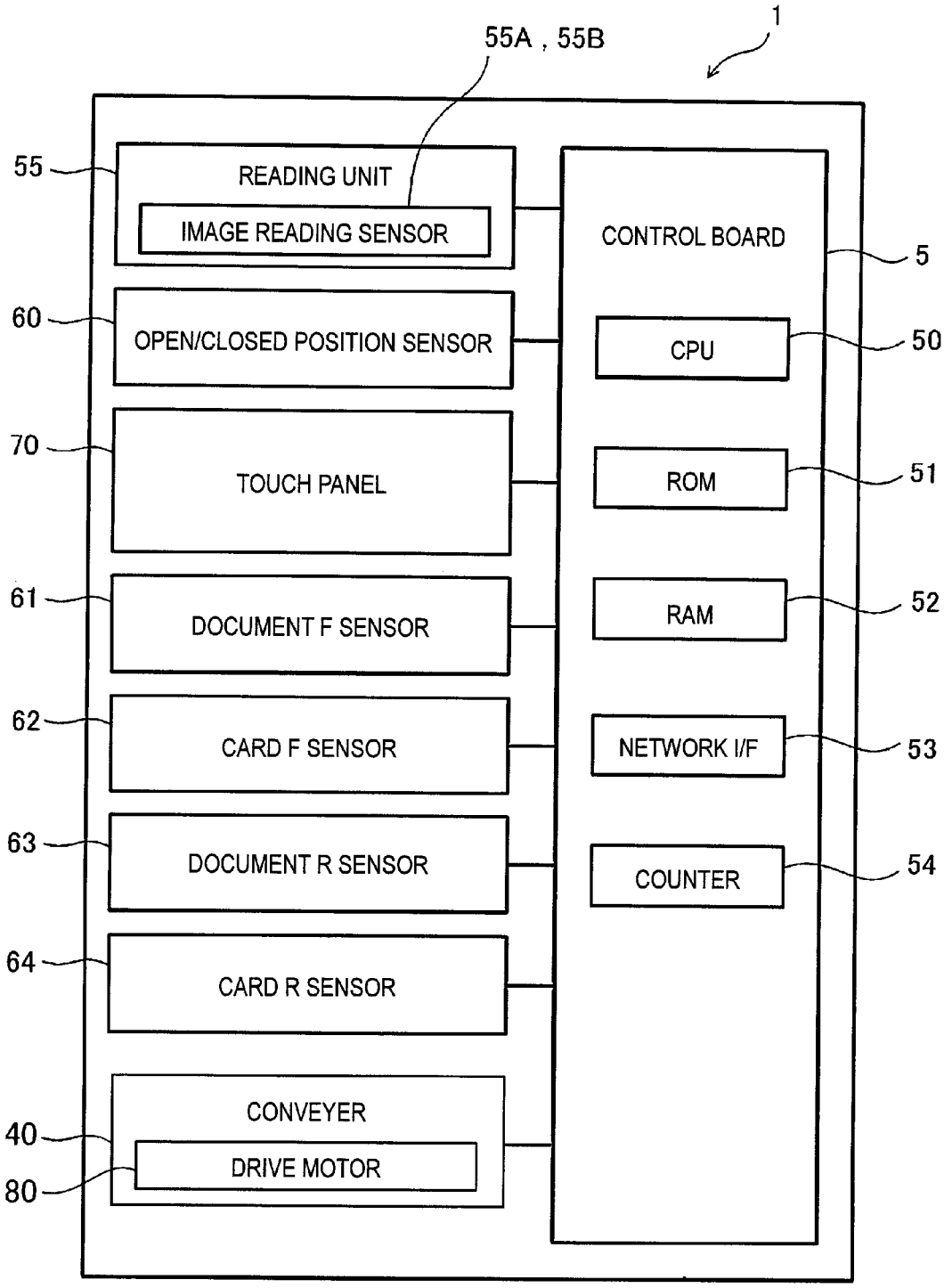
FIG. 7 is a block diagram schematically illustrating the electrical configuration of the image reading apparatus.

Hereinafter, the electrical configuration of the image reading apparatus 1 will be described with reference to FIG. 7. As shown in FIG. 7, the image reading apparatus 1 includes a CPU 50 (an example of a controller), a ROM 51, a RAM 52, a network interface (hereinafter, referred to as a network I/F) 53, and a counter 54, mounted on the control board 5. The control board 5 is connected to the reading unit 55, the sensors 60 to 64, the touch panel 70, the drive motor 80, and so on.

The ROM 51 stores programs for performing a scanning function (to be described below), and programs for performing a variety of operations of the image reading apparatus 1. The CPU 50 controls each unit of the image reading apparatus 1 according to programs read from the ROM 51 while using the RAM 52.

The reading unit 55 includes image reading sensors 55A and 55B shown in FIGS. 5 to 7. The reading unit 55 is an example of an image processor of this disclosure. The image reading sensor 55A is assembled between the conveying rollers 42 and the discharging rollers 44 in the second housing 32. The image reading sensor 55B is assembled between the driven rollers 43 and the driven rollers 45 in the first housing 31. That is, the image reading sensors 55A and 55B face each other with the second conveyance path 10 interposed therebetween in the vertical direction. Additionally, since a portion of the second conveyance path 10 also serves as a portion of the first conveyance path 20, the image reading sensors 55A and 55B face each other in the vertical direction such that the first conveyance path 20 is interposed therebetween as shown in FIGS. 5 and 6. As the image reading sensors 55A and 55B, for example, contact image sensors (CIS), charge coupled devices (CCD), and the like can be used.

The image reading sensor 55A turns on a light source (not shown) according to a command from the CPU 50 so as to irradiate the lower surface of a document SH or a card CA passing above the image reading sensor 55A, with light, and receives light reflected from the document SH or the card CA, thereby outputting a signal according to the image of the lower surface of the document SH or the card CA. The image reading sensor 55A transmits the output signal to the CPU 50. Based on the output signal, the CPU 50 generates image data, and stores the image data in the RAM 52.

The image reading sensor 55B turns on a light source (not shown) according to a command from the CPU 50 so as to irradiate the upper surface of a document SH or a card CA passing below the image reading sensor 55B, with light, and receives light reflected from the document SH or the card CA, thereby outputting a signal according to the image of the upper surface of the document SH or the card CA. The image reading sensor 55B transmits the output signal to the CPU 50. Based on the output signal, the CPU 50 generates image data, and stores the image data in the RAM 52.

The open/closed position sensor (an example of a cover sensor) 60 detects the open/closed state of the tray cover 36 as shown in FIG. 1, FIG. 3, and so on, and transmits a detection signal corresponding to each state to the CPU 50. More specifically, the open/closed position sensor 60 is provided at the upper end portion of the rear side of the right side frame 33R, and thus is close to the right side frame 33R. The open/closed position sensor 60 is composed of a microswitch, a rotary switch, or the like, and is switched according to rotation of the tray cover 36 around the rotation axis X1.

The touch panel 70 includes, for example, a liquid crystal display (LCD), and is provided at the center of the top surface of the first housing 31 as shown in FIG. 3. The touch panel 70 displays information to be notified to the outside. Specifically, the touch panel 70 is controlled by the CPU 50 such that the touch panel displays the operating status and the like of the image reading apparatus 1 such as the processing status of an image reading operation, and an error status. Meanwhile, the touch panel 70 receives an operation from the outside. Specifically, for example, the touch panel 70 displays a variety of buttons such as a "START" button BT1 for receiving an instruction to start driving of the conveyer 40 and a "STOP" button BT2 for receiving an instruction to stop driving of the conveyer 40, as shown in FIG. 1. Then, when the user touches the touch panel 70 to issue an instruction to start or stop a process corresponding to any one button, or to input options, or to perform any other process, the touch panel 70 receives the user's operation, and transmits reception information to the CPU 50.

Meanwhile, reception of an instruction for starting or stopping driving of the conveyer 40 does not necessarily need to be performed through the touch panel 70. For example, the corresponding instruction may be received from an information terminal such as a smart phone or a personal computer connected to the image reading apparatus 1 such that information transmission is possible, through the network I/F 53.

The document F sensor 61 is positioned around the separating pad 49 as shown in FIGS. 4 and 6, and transmits, to the CPU 50, a detection signal corresponding to whether there is a document SH in the second conveyance path 10 at the second introducing opening 11.

The card F sensor (an example of a sheet sensor) 62 is positioned on the upstream side with respect to the first conveyer 40A in a card conveyance direction such that the card F sensor 62 is exposed to the first conveyance path 20, as shown in FIGS. 4 and 5. The card F sensor 62 transmits a detection signal corresponding to whether there is a card CA in the first conveyance path 20 at the first introducing opening 21, to the CPU 50.

Meanwhile, the document R sensor 63 is positioned on the upstream side with respect to the image reading sensor 55B of the first housing 31 in a document conveyance direction, and on the downstream side with respect to the driven rollers 43, as shown in FIGS. 4 and 6. The document R sensor 63 transmits a detection signal corresponding to whether there is a document SH in the second conveyance path 10 between the reading unit 55 and the driven rollers 43, to the CPU 50.

The card R sensor 64 is positioned on the upstream side with respect to the image reading sensor 55A of the second housing 32 in the card conveyance direction, and on the downstream side with respect to the conveying roller 42 in the card conveyance direction, as shown in FIGS. 4 and 5. The card R sensor 64 transmits a detection signal corresponding to whether there is a card CA in the first conveyance path 20 between the reading unit 55 and the conveying roller 42, to the CPU 50.

Meanwhile, in the present illustrative embodiment, the drive motor 80 is, for example, a stepping motor, and the counter 54 counts the number of driving Steps at whenever the drive motor 80 is driven by one step. According to the number of driving Steps counted by the counter 54, the CPU 50 controls rotation of the drive motor 80.

3. Scanning Function

Hereinafter, the scanning function of the image reading apparatus 1 configured as described above will be described with reference to FIGS. 8 to 12. Each process of the scanning function is performed by the CPU 50, for example, according to a program stored in the ROM 51. Meanwhile, the processing order of each process related to the scanning function is not limited to the order shown in FIGS. 8 to 12. The processing order may be appropriately changed.

3-1. Main Process

Figure 8:
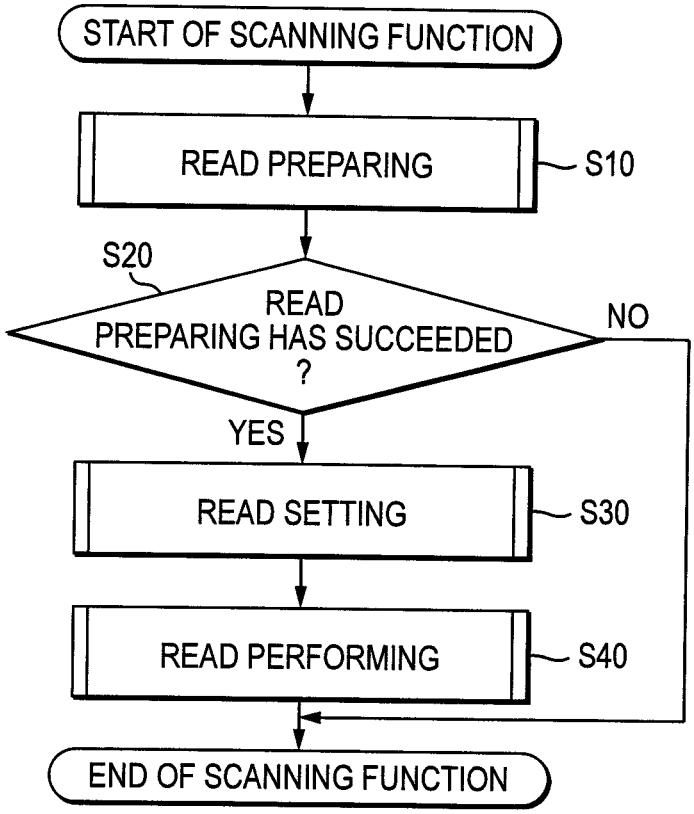
FIG. 8 is a flow chart of a main process illustrating a function of scanning a card and a document which is performed by the image reading apparatus.

If the image reading apparatus 1 is powered on, a main process starts. As shown in FIG. 8, the main process includes a read preparing process, a read setting process, and a read performing process. Each process will be described below in detail.

If the main process starts, the CPU 50 first performs the read preparing process of Step S10 for reading a document SH or a card CA. Next, in Step S20, the CPU 50 determines whether the read preparing has succeeded in the read preparing process, according to information representing that the read preparing result is "SUCCESS", stored in the RAM 23, or information representing that the read preparing result is "FAILURE", stored in the RAM 23. In a case where it is determined that the read preparing has not succeeded ("NO" in Step S20), the CPU 50 finishes the scanning function. Meanwhile, in a case where it is determined that the read preparing has succeeded ("YES" in Step S20), in Step S30, the CPU 50 performs the read setting process.

After the read setting process finishes, in Step S40, the CPU 50 performs the read performing process to read the image of the document SH or the card CA. After the reading process finishes, the CPU 50 finishes the scanning function.

3-2. Read Preparing Process

Hereinafter, the read preparing process will be described with reference to FIG. 9.

In the read preparing process, the CPU 50 first determines whether the card F sensor 62 is ON-state or not, based on the detection signal from the card F sensor 62. That is, in Step S105, the CPU 50 detects existence of a card CA. In a case where it is determined that the card F sensor 62 is not ON-state ("NO" in Step S105), the CPU 50 determines whether the document F sensor 61 is ON-state or not, based on the detection signal from the document F sensor 61. That is, in Step S110, the CPU 50 detects existence of a document SH.

In a case where it is determined that the document F sensor 61 is ON-state ("YES" in Step S110), the CPU 50 determines that a document SH has been mounted on the tray cover 36 by a user and the leading end of the document SH has been introduced in the second introducing opening 11. In this case, since it is considered that the document SH has been set at a position where the feeding roller 41 and the separating pad 49 abut each other, and read preparing for the document SH has been completed, the CPU 50 stores information representing that the read preparing result is "SUCCESS OF READ PREPARING FOR DOCUMENT SH", in the RAM 52, in Step S180, and finishes the read preparing process. Meanwhile, in a case where it is determined that the document F sensor 61 is not ON-state ("NO" in Step S110), the CPU 50 returns to Step S105.

Meanwhile, in a case where it is determined in Step S105 that the card F sensor 62 is ON-state ("YES" in Step S105), in Step S115, the CPU 50 determines whether the tray cover 36 is in the closed state, based on the detection signal from the open/closed position sensor 60. Here, the determination of "YES" in Step S110 corresponds to an example of a receiving process of receiving a drive instruction for driving the conveyer 40.

In a case where it is determined that the tray cover 36 is not in the closed state, that is, the tray cover 36 is in the open state ("NO" in Step S115), in Step S120, the CPU 50 performs display for notifying the user to close the tray cover 36, for example, on the touch panel 70. Then, the CPU 50 returns to Step S105.

Meanwhile, in a case where it is determined that the tray cover 36 is in the closed state ("YES" in Step S115), since it is considered that the user intends to make the image reading apparatus 1 read the card CA, in Step S125 (an example of a driving process), the CPU 50 controls the drive motor 80, thereby driving the conveyer 40 such that an conveying operation to convey the card CA starts.

As described above, in the present illustrative embodiment, in a case where it has been determined the card F sensor 62 is ON-state, when it is determined that the tray cover 36 is in the closed state, the CPU 50 drives the conveyer 40 in the driving process. Therefore, as compared to a case where the conveyer 40 is driven as long as the tray cover 36 is in the closed state, electric power is not wastefully consumed, and thus is saved. Meanwhile, in the present illustrative embodiment, in the receiving process, the CPU 50 receives the drive instruction which is a detection signal generated when the card CA is detected by the card F sensor 62. Accordingly, when the cover is closed, since it is possible to drive the conveyer 40 at timing when a card CA is introduced into the first introducing opening 21, it is possible to perform a read preparing process for the card CA while suppressing a collision with a document SH.

Next, the CPU 50 detects whether the "STOP" button BT2 displayed on the touch panel 70 has been pressed after the start of the conveying operation. That is, in Step S130, the CPU 50 determines whether a stop instruction from the user has been received. In a case where the "STOP" button has been pressed and the stop instruction has been received ("YES" in Step S130), since it is considered that an abnormality such as generation of an abnormal sound according to the conveyance of the card CA has occurred, in Step S160, the CPU 50 stops the driving of the drive motor 80 in Step S155, and displays the "STOP" button and a method of removing the card CA, such as figures or letters representing an operation sequence for removing the card CA, on the touch panel 70. Next, in Step S165, the CPU 50 detects whether the "STOP" button has been pressed. The CPU 50 repeatedly performs the determination of Step S165 until pressing of the "STOP" button is detected ("NO" in Step S165).

If the "STOP" button is pressed ("YES" in Step S165), since it is considered that the user has determined that an abnormality according to conveyance of the card CA would not occur even when an conveying operation on the stopped card CA restarted, in Step S170, the CPU 50 performs a discharging operation. That is, as a conveying operation, the CPU 50 drives the drive motor 80 by a number of steps that is need to convey the card CA from a position where the leading end of the card CA is located at the nip position of the conveying roller 42 and the driven roller 43 to a position where the rear end of the card CA is located at the nip position of the discharging roller 44 and the driven roller 45, thereby conveying the card CA toward the first discharging opening 12A and discharging the card CA to the outside of the image reading apparatus. Thereafter, the CPU 50 stores information representing that the read preparing result is "FAILURE", in the RAM 52 in Step S175, and finishes the read preparing process.

Meanwhile, in a case where it is determined in Step S130 that the "STOP" button has not been pressed and a stop instruction has not been received ("NO" in Step S130), in Step S135, similarly in Step S115, the CPU 50 determines whether the tray cover 36 is in the closed state, again, based on the detection signal of the open/closed position sensor 60.

In a case where it is determined that the tray cover 36 is not in the closed state, that is, the tray cover 36 is in the open state ("NO" in Step S135), in Step S137 (an example of a suppressing process), the CPU 50 performs display of suppressing introducing of a document SH into the second introducing opening 11, for example, on the touch panel 70.

That is, in a case where the open/closed position sensor 60 detects the open state of the tray cover 36 while driving the conveyer 40 (during the driving process), the CPU 50 performs the suppressing process of suppressing introducing of a document SH into the second introducing opening 11. Therefore, while the card CA introduced in the first introducing opening 21 is being conveyed, it is possible to maintain the conveyance of the card CA while suppressing a document SH introduced in the second introducing opening 11 from being conveyed. At this time, display of suppressing introducing of a document SH into the second introducing opening 11 is performed on the touch panel 70 for notification to the outside, whereby it is possible to notify the user not to introduce a document SH into the second introducing opening 11.

Meanwhile, in a configuration in which the drive motor 80 is commonly used to transmit power to the first conveyer 40A and the second conveyer 40B like in the present illustrative embodiment, while a card CA is being conveyed, a document SH having been introduced in the second introducing opening 11 is likely to be conveyed. Specifically in the configuration in which the drive motor 80 is commonly used, the suppressing process is performed, whereby while a card CA introduced in the first introducing opening 21 is being conveyed, it is possible to maintain the conveyance of the card CA while suppressing a document SH introduced in the second introducing opening 11 from being conveyed.

Meanwhile, in Step S137, instead of display of suppressing introducing of a document SH into the second introducing opening 11, similarly in Step S120, display for notifying the user to close the tray cover 36 may be performed on the touch panel 70.

Alternatively, in the case where it is determined that the tray cover 36 is in the open state ("NO" in Step S135), the CPU 50 may proceed to Step S155, instead of the process of the Step S137, and perform the above described processes of Steps S155 to S175. That is, in a case where the tray cover 36 is opened during conveyance of the card CA, reading of the card CA may be stopped.

Meanwhile, in a case where it is determined in Step S135 that the tray cover 36 is in the closed state ("YES" in Step S135), in Step S140, the CPU 50 determines whether the card R sensor 64 is ON-state, based on the detection signal from the card R sensor 64. In a case where it is determined that the card R sensor 64 is not ON-state ("NO" in Step S140), the CPU 50 returns to Step S130 to maintain the conveying operation. That is, in Steps S130 and S135, the CPU 50 monitors whether the user presses the "STOP" button and whether the tray cover 36 is opened, after the start of the conveying operation until the leading end of the card CA passes the position of the card R sensor 64.

Meanwhile, in a case where it is determined that the card R sensor 64 is ON-state ("YES" in Step S140), since it is considered that the leading end of the card CA introduced from the first introducing opening 21 by the user has been nipped by the conveying roller 42B and the driven roller 43B, resulting in completion of the read preparing for the card CA, in Step S145, the CPU 50 stops the driving of the drive motor 80 such that the conveying operation to convey the card CA stops. Next, the CPU 50 stores information representing that the read preparing result is "SUCCESS OF READ PREPARING FOR CARD CA", in the RAM 52, in Step S150, and finishes the read preparing process.

Meanwhile, in the read preparing process, the process of Step S105 may be omitted such that the read preparing process starts with the process of Step S115.

3-3. Read Setting Process

Figure 10:
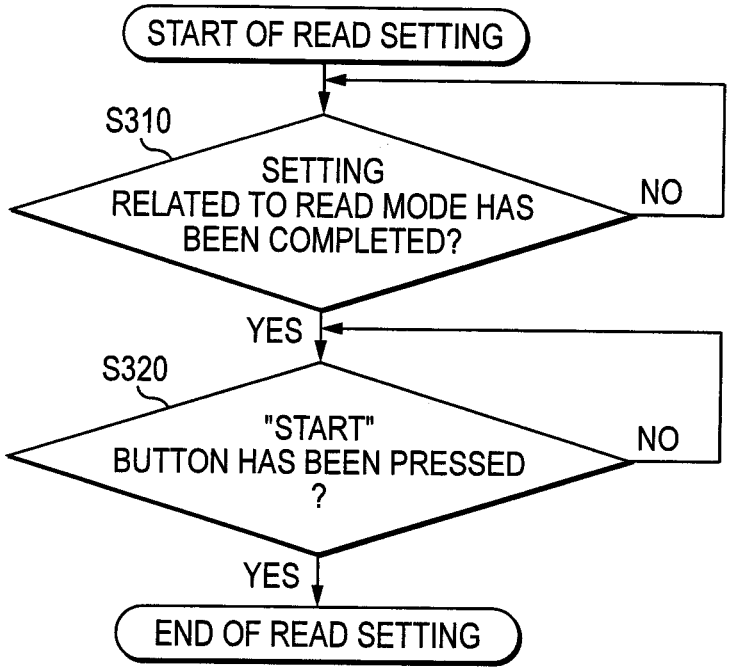
FIG. 10 is a flow chart of a read setting process which is performed in the main process.

Hereinafter, the read setting process will be described with reference to FIG. 10.

First, in Step S310, after performing the setting related to the read mode through the touch panel 70, the CPU 50 determines whether setting related to a read mode has been completed, for example, by receiving a completion instruction from the user. The CPU 50 repeatedly performs the determination of Step S310 until it is determined that the setting related to the read mode is completed ("NO" in Step S310). Meanwhile, examples of the setting related to the read mode include setting of a read resolution, setting on whether to read in color or in monochrome, and setting on whether to perform single-sided reading or dual-sided reading. This setting may be set, for example, by an operation of the user on the touch panel 70 or setting information set in advance may be read. Alternatively, the setting may be set through the network I/F 53. In this case, for example, when a read completion signal is received when the reading is completed, the CPU 50 determines that the setting related to the read mode has been completed.

Next, after completion of the setting related to the read mode ("YES" in Step S310), in Step S320, the CPU 50 determines whether the "START" button BT1 displayed on the touch panel 70 has been pressed. The CPU 50 repeatedly performs the determination of Step S320 until pressing of the "START" button BT1 is determined ("NO" in Step S320). When the "START" button BT1 is pressed ("YES" in Step S320), since it is considered that the user has determined that it would be possible to start conveyance and reading of the document SH or the card CA and a read start instruction is issued, the CPU 50 finishes the read setting process.

Here, the determination of "YES" in Step S320 corresponds to an example of the receiving process of receiving a drive instruction for driving the conveyer 40, and in this receiving process, a drive instruction which is an instruction for starting a reading process (an example of processing on image data) of the reading unit (the image processor) 55 is received. Therefore, when the tray cover 36 is in the closed state, since it is possible to drive the conveyer 40 at the timing when an instruction for staring the reading process of the reading unit 55 is issued, it is possible to start the read performing process while suppressing a collision with a document SH.

3-4. Read Performing Process

Hereinafter, the read performing process will be described with reference to FIGS. 11 and 12.

3-4-1. Document Read Performing Process

First, an operation process related to reading of a document SH will be described with reference to FIGS. 11A and 11B.

First, in Step S402, the CPU 50 determines whether the read preparing having succeeded in the read preparing process of Step S10 is for reading a card, based on the information stored in the RAM 52 in the read preparing process. In a case where it is determined that the read preparing is for reading a card ("YES" in Step S402), the CPU 50 proceeds to Step S440 related to a card reading process shown in FIG. 12.

Meanwhile, in a case where it is determined that the read preparing is not for reading a card, that is, the read preparing is for reading a document ("NO" in Step S402), in Step S404, the CPU 50 controls the drive motor 80, thereby driving the conveyer 40 such that an conveying operation to convey the document SH starts. Next, in Step S406, the CPU 50 determines whether the card F sensor 62 is ON-state. That is, the CPU 50 determines whether a card CA has been introduced into the first introducing opening 21 during conveyance of the document SH.

In a case where it is determined that the card F sensor 62 is ON-state ("YES" in Step S406), in Step S432, the CPU 50 stops the conveyance of the document SH. Thereafter, when it is determined that the card F sensor 62 is ON-state ("YES" in Step S434), in Step S436, the CPU 50 displays, for example, a method of removing a card CA, for example, on the touch panel 70. As the method of removing the card CA, for example, information representing that it is possible to remove the card CA by drawing out the card CA from the first introducing opening 21 may be displayed. Thereafter, when the card CA is removed and the user presses the "STOP" button BT2 ("YES" in Step S438), in Step S428, the CPU 50 restarts control on the drive motor 80, thereby restarting driving of the conveyer 40 such that the document SH is discharged from the discharging opening 12.

As described above, after conveyance of a document SH starts in order to read the document SH, when a card CA is introduced into the first introducing opening 21, the card CA is removed, for example, from the first introducing opening 21, and then, the document SH is discharged from the discharging opening 12. Therefore, it is possible to avoid simultaneous usage of a section K1 (see FIG. 5), in which the first conveyance path 20 and the second conveyance path 10 overlap, by a card and a document. That is, it is possible to avoid occurrence of a jam due to a collision between a card CA having been introduced in the first introducing opening 21 and a document SH having been introduced in the second introducing opening 11.

Meanwhile, in a case where it is determined in Step S406 that the card F sensor 62 is not ON-state ("NO" in Step S406), in Step S408, the CPU 50 determines whether the document R sensor 63 is ON-state, based on the detection signal from the document R sensor 63. The CPU 50 repeatedly performs the determinations of Steps S406 and S408 until it is determined that the document R sensor 63 is ON-state ("NO" in Step S408).

Meanwhile, in a case where it is determined that the document R sensor 63 is ON-state ("YES" in Step S408), since it is considered that the leading end of the document SH has reached a position facing the document R sensor 63, in Step S410, the CPU 50 sets the number of steps of the drive motor 80 necessary to start reading of the document SH, that is, the number of steps that is need to convey the document SH from a position where the leading end of the document SH faces the document R sensor 63 until the leading end is located at the read position of the image reading sensor 55, in the RAM 52.

Next, the CPU 50 drives the drive motor 80 in units of one step, and determines whether the number of remaining steps of the number of steps set by Step S410 is 0, in Step S412. The CPU 50 repeatedly performs the process of Step S412 until the number of remaining steps becomes "0" ("NO" in Step S412). Meanwhile, in a case where the number of remaining steps is "0" ("YES" in Step S412), since it is considered that the leading end of the document SH has been conveyed up to the read position of the image reading sensor 55, in Step S414, the CPU 50 turns on the image reading sensor 55 and controls the reading unit 55 according to the setting contents set in Step S310 of the read setting process, so that reading starts.

Next, in Step S416, the CPU 50 determines whether the card F sensor 62 is ON-state, that is, whether a card CA has been introduced in the first introducing opening 21 during reading of the document SH. In a case where it is determined that the card F sensor 62 is ON-state ("YES" in Step S416), in Step S430, the CPU 50 finishes the reading of the document SH, that is, the CPU 50 turns off the image reading sensor 55. Then, the CPU 50 proceeds to Step S432 in which the CPU 50 stops the driving of the drive motor 80, thereby stopping the conveying operation to convey the document SH.

As described above, even when a card CA is introduced into the first introducing opening 21 while reading of a document SH, the card CA can be removed, for example, from the first introducing opening 21, and then, the document SH can be discharged from the discharging opening 12. Therefore, it is possible to avoid simultaneous usage of the section K1, in which the first conveyance path 20 and the second conveyance path 10 overlap, by a card and a document. As a result, it is possible to avoid occurrence of a jam due to a collision between a card CA having been introduced in the first introducing opening 21 and a document SH having been introduced in the second introducing opening 11. That is, even in a configuration in which the first conveyance path 20 and the second conveyance path 10 join together, it is possible to suppress a document SH and a card CA from being introduced and conveyed from both introducing openings 11 and 21.

Meanwhile, in a case where it is determined in Step S416 that the card F sensor 62 is not ON-state ("NO" in Step S416), in Step S418, the CPU 50 determines whether the "STOP" button BT2 on the touch panel 70 has been pressed after the start of the reading of the document SH. That is, the CPU 50 determines whether a read stop instruction from the user has been received.

In a case where the "STOP" button BT2 has been pressed and a stop instruction from the user has been received ("YES" in Step S418), in Step S430, although the document SH is being read, the CPU 50 turns off the image reading sensor 55, thereby finishing the reading. Next, in Step S432, the CPU 50 stops the driving of the drive motor 80 such that the conveyance of the document SH stops. Next, in Step S434, the CPU 50 determines whether the card F sensor 62 is ON-state.

In this case, since there is no card CA introduced in the first introducing opening 21, the CPU 50 determines that the card F sensor 62 is not ON-state ("NO" in Step S434). In this case, since it is considered that an abnormality according to driving will not occur, the CPU 50 proceeds to Step S435 in which the CPU 50 performs display of suppressing introducing of a card CA into the first introducing opening 21, on the touch panel 70.

Meanwhile, in a case where it is determined in Step S418 that the "STOP" button BT2 has not been pressed and a stop instruction from the user has not been received ("NO" in Step S418), in Step S420, the CPU 50 detects whether the document R sensor 63 is OFF-state or not, that is, whether the rear end of the document SH has passed the document R sensor 63. In a case where it is determined that the document R sensor 63 is not off, that is, the rear end of the document SH has not passed the document R sensor 63 ("NO" in Step S420), the CPU 50 returns to Step S416. Meanwhile, in a case where it is determined that the document R sensor 63 is OFF-state or not, that is, the rear end of the document SH has passed the document R sensor 63 ("YES" in Step S420), in Step S422, the CPU 50 sets the number of steps of the drive motor 80 that is needed to finish the reading of the document SH, that is, the number of steps that is need to convey the document SH from a position where the rear end of the document SH is detected by the document R sensor 63 until the rear end passes the read position of the image reading sensor 55, in the RAM 52.

Next, the CPU 50 drives the drive motor 80 in units of one step, and determines whether the number of remaining steps that is needed to finish the reading, set by Step S422, is 0, in Step S424. The CPU 50 repeatedly performs the process of Step S424 until the number of remaining steps of the drive motor 80 that is needed to finish the reading, set in the RAM 52, becomes 0 ("NO" in Step S424). In a case where the number of remaining steps is 0 ("YES" in Step S424), since it is considered that the document SH has been conveyed to a position where it is possible to finish the reading of the document SH, in Step S426, the CPU 50 turns off the image reading sensor 55, thereby finishing the reading.

Hereinafter, in Step S428, the CPU 50 performs a discharging operation. That is, the CPU 50 drives the drive motor 80 by a number of steps that is need to convey the document SH from a position where the rear end of the document SH passes the read position of the image reading sensor 55 to a position where the rear end of the document SH is located at the nip position of the discharging roller 44 and the driven roller 45, thereby performing a conveying operation to convey the document SH toward the second discharging opening 12B and discharging the document SH to the outside of the image reading apparatus. After the above described discharging operation is performed, the CPU 50 resets the number of driving steps of the drive motor 80 stored in the RAM 52, and finishes the read performing process.

Meanwhile, it is assumed that the determination of each of Steps S406, S416, and S434 is performed at the time when the leading end of the card CA reaches the card F sensor 62. Accordingly, during the determination of Step S406, it is considered that the leading end of the card CA has not been introduced up to the position where the leading end is nipped by the conveying roller 42B and the driven roller 43B.

3-4-2. Card Reading Process

Hereinafter, an operation process related mainly to reading of a card CA will be described with reference to FIG. 12.

Figure 11A:
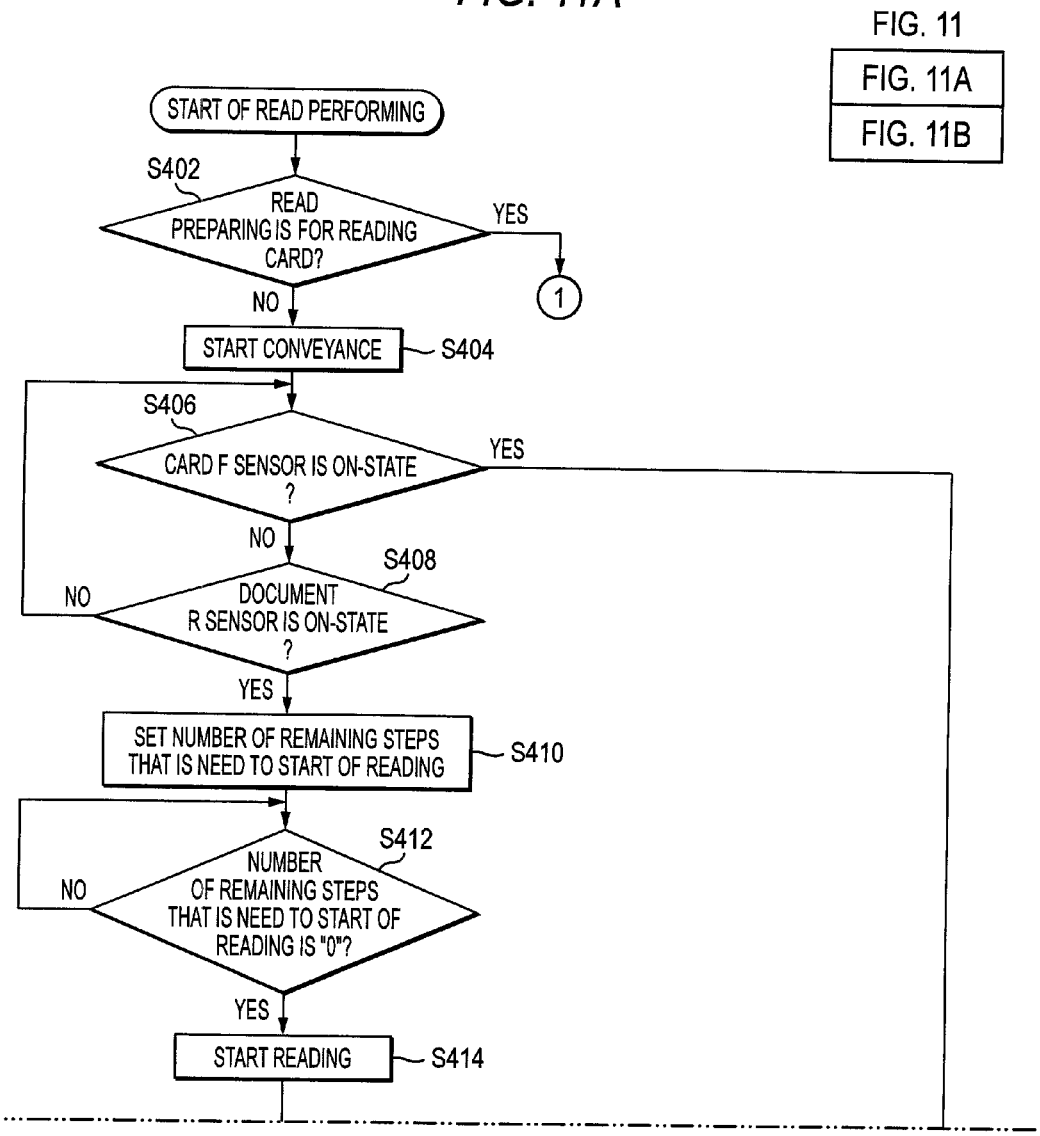
FIGS. 11A and 11B are a flow chart of a document read performing process which is performed in the main process.
Figure 11B:
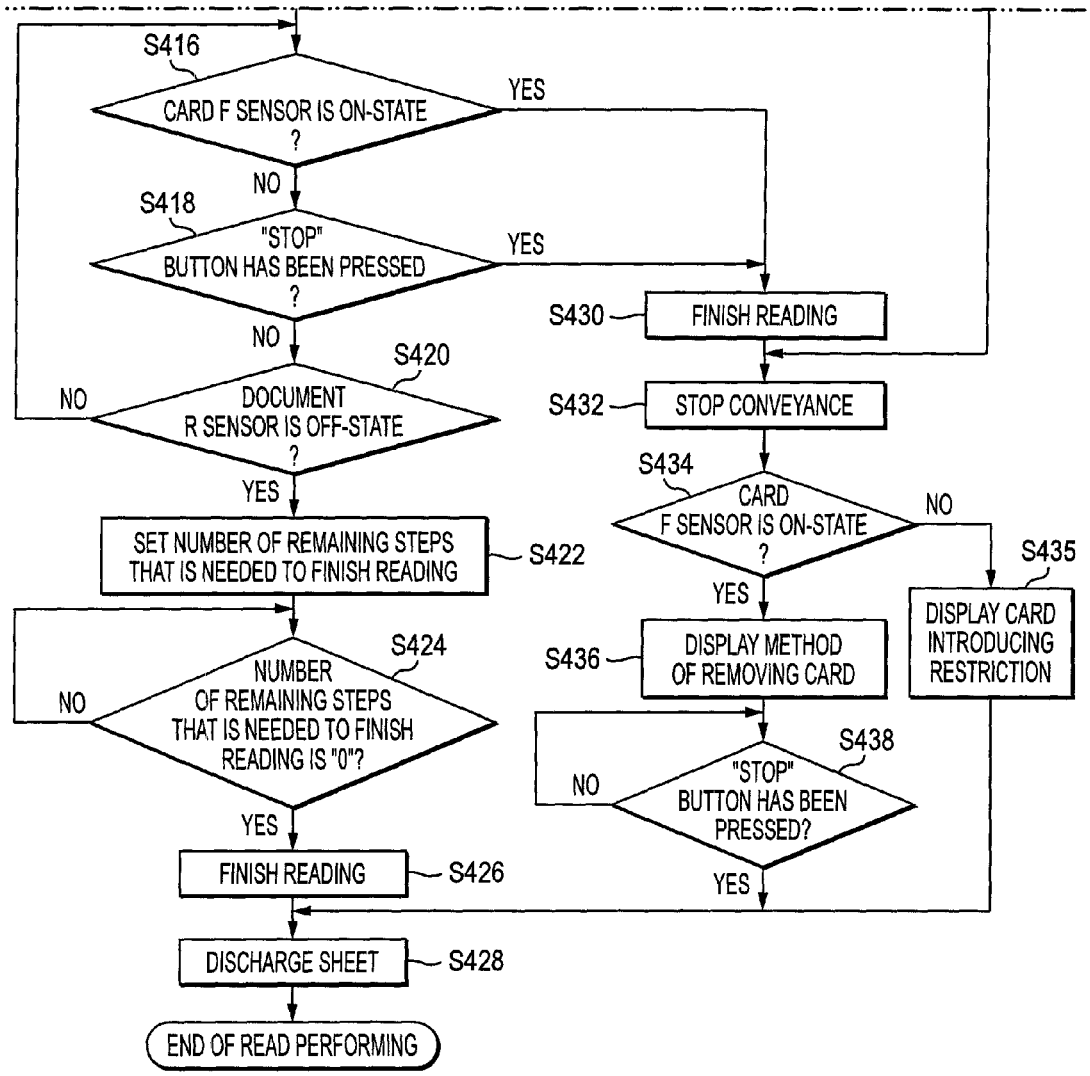

In a case where it is determined in Step S402 of FIG. 11A that the read preparing is for reading a card ("YES" in Step S402), in Step S440, the CPU 50 sets the number of steps of the drive motor 80 necessary to start reading of the card CA, that is, the number of steps that is need to convey the card CA from a position where the leading end of the card CA faces the card R sensor 64 until the leading end is located at the read position of the image reading sensor 55, in the RAM 52.

Next, in Step S442, the CPU 50 drives the drive motor 80 in units of one step, so that conveyance of the card CA starts. Hereinafter, in Step S444, the CPU 50 determines whether the number of remaining steps of the number of steps set by Step S440 is 0. The CPU 50 repeatedly performs the process of Step S444 until the number of remaining steps becomes "0" ("NO" in Step S444). Meanwhile, in a case where the number of remaining steps is "0" ("YES" in Step S444), since it is considered that the leading end of the card CA has been conveyed up to the read position of the image reading sensor 55, in Step S446, the CPU 50 turns on the image reading sensor 55 and controls the reading unit 55 according to the setting contents set in Step S310 of the read setting process, so that reading of the card CA starts.

Next, in Step S448, the CPU 50 determines whether the tray cover 36 is in the closed state, based on the detection signal from the open/closed position sensor 60. In a case where it is determined that the tray cover 36 is not in the closed state, that is, the tray cover 36 is in the open state ("NO" in Step S448), the CPU 50 finishes the reading of the card CA in Step S460, and stops control on the drive motor 80 such that the driving of the conveyer 40 stops. As a result, the conveying operation to convey the card CA stops in Step S462 (an example of a stopping process). Next, in Step S464, the CPU 50 displays, for example, a method of removing the card CA on the touch panel 70. For example, on the touch panel 70, information representing that the user opens the first housing 31 upwardly and removes the card CA may be displayed. Here, it is assumed that the first housing 31 is configured to be able to open or close for a jammed-sheet removing operation or the like.

As described above, in a case where the open/closed position sensor 60 detects the open state of the tray cover 36 while driving the conveyer 40, the driving of the conveyer 40 is stopped. Therefore, while the card CA introduced in the first introducing opening 21 is being conveyed, it is possible to surely suppress a document SH introduced in the second introducing opening 11 from being conveyed with the conveyance of the card CA.

Next, in Step S466, the CPU 50 determines whether the "STOP" button BT2 on the touch panel 70 has been pressed after the stop of the conveyance of the card CA. That is, the CPU 50 determines whether a read stop instruction from the user has been received. The CPU 50 waits until the "STOP" button BT2 is pressed and a stop instruction from the user is received (NO" in Step S466), and when a stop instruction is received ("YES" in Step S466), in Step S468, the CPU 50 performs a discharging operation of discharging the card CA from the first discharging opening 12A. Since it is considered that the card CA has been removed, in this discharging operation, the conveyer 40 will idle.

Accordingly, in a case where the tray cover 36 is opened while reading of a card CA, the reading of the card CA is stopped, and conveyance of the card CA is stopped. Therefore, it is possible to avoid simultaneous usage of the section K1, in which the first conveyance path 20 and the second conveyance path 10 overlap, by a card and a document. As a result, it is possible to avoid occurrence of a jam due to a collision between a card CA having been introduced in the first introducing opening 21 and a document SH having been introduced in the second introducing opening 11. That is, even in a configuration in which the first conveyance path 20 and the second conveyance path 10 join together, it is possible to suppress a document SH and a card CA from being introduced and conveyed from both introducing openings 11 and 21.

Meanwhile, in the case where it is determined in Step S448 that the tray cover 36 is in the open state ("NO" in Step S448), instead of the processes of Steps S460 to S466, simply, like in Step S120, the CPU 50 may perform display for notifying the user to close the tray cover 36, for example, on the touch panel 70. Alternatively, like in Step S137, the CPU 50 may perform display of suppressing introducing of a document SH into the second introducing opening 11, for example, on the touch panel 70. Even in this case, it is possible to suppress a document SH from being introduced into the second introducing opening 11 during the reading of the card CA.

Meanwhile, in a case where it is determined in Step S448 that the tray cover 36 is in the closed state ("YES" in Step S448), in Step S450, the CPU 50 determines whether the "STOP" button BT2 has been pressed after the start of the reading of the card CA. That is, the CPU 50 determines whether a read stop instruction from the user has been received.

In a case where the "STOP" button BT2 has been pressed and a stop instruction from the user has been received ("YES" in Step S450), the CPU 50 performs the processes of Steps S460 to S468. Meanwhile, in a case where the "STOP" button BT2 has not been pressed and a stop instruction from the user has not been received ("NO" in Step S450), in Step S452, the CPU 50 detects whether the card R sensor 64 is OFF-state or not, that is, whether the rear end of the card CA has passed the card R sensor 64.

In a case where it is determined that the card R sensor 64 is not off, that is, the rear end of the card CA has not passed the card R sensor 64 ("NO" in Step S452), the CPU 50 returns to Step S448 in which the CPU 50 keeps the reading of the card CA. Meanwhile, in a case where it is determined that the card R sensor 64 is OFF-state or not, that is, the rear end of the card CA has passed the card R sensor 64 ("YES" in Step S452), in Step S454, the CPU 50 sets the number of steps of the drive motor 80 that is needed to finish the reading of the card CA, that is, the number of steps that is need to convey the card CA from a position where the rear end of the card CA is detected by the card R sensor 64 until the rear end passes the read position of the image reading sensor 55, in the RAM 52.

Next, the CPU 50 drives the drive motor 80 in units of one step. In Step S456, determines whether the number of remaining steps that is needed to finish the reading, set by Step S454, is 0. The CPU 50 repeatedly performs the process of Step S456 until the number of remaining steps of the drive motor 80 that is needed to finish the reading, set in the RAM 52, becomes 0 ("NO" in Step S456). In a case where the number of remaining steps is 0 ("YES" in Step S456), since it is considered that the card CA has been conveyed to a position where it is possible to finish the reading of the card CA, in Step S458, the CPU 50 turns off the image reading sensor 55, thereby finishing the reading.

Hereinafter, in Step S468, the CPU 50 performs a discharging operation. That is, the CPU 50 drives the drive motor 80 by a number of steps that is need to convey the card CA from a position where the rear end of the card CA passes the read position of the image reading sensor 55 to a position where the rear end of the card CA is located at the nip position of the discharging roller 44 and the driven roller 45, thereby performing a conveying operation to convey the card CA toward the first discharging opening 12A and discharging the card CA to the outside of the image reading apparatus. After the above described discharging operation is performed, the CPU 50 resets the number of driving steps of the drive motor 80 stored in the RAM 52, and finishes the read performing process on the card CA.

4. Effect of Illustrative Embodiment

In the present illustrative embodiment, in a case where the open/closed position sensor 60 detects the closed state of the tray cover 36 ("YES" in Step S115), the CPU 50 performs a driving process of driving the conveyer 40 in Step S125. Therefore, when the tray cover 36 is in the closed state, only a card CA introduced in the first introducing opening 21, which is the open state, can be conveyed. Therefore, it is possible to avoid a state in which it is always possible to introduce a card CA and a document SH into the first introducing opening 21 and the second introducing opening 11, respectively, and thus it is possible to reduce the frequency of restriction of sheet conveyance. As a result, in a configuration having two introducing openings, it is possible to maintain convenience while suppressing inconvenience, such as a collision between a card CA and a document SH, due to simultaneous conveyance of a plurality of sheets.

Other Illustrative Embodiments

This disclosure is not limited to the illustrative embodiment described above with reference to the drawings. For example, the following illustrative embodiments are also included in the technical range of this disclosure.

(1) In the above described illustrative embodiment, an example in which the drive motor 80 is commonly used to transmit power to the first conveyer 40A and the second conveyer 40B has been described. However, this disclosure is not limited thereto. This disclosure can be applied to a configuration in which transmission of power to the first conveyer 40A and transmission of power to the second conveyer 40B are performed by separate motors.

That is, the conveyer 40 may include a first conveyer 40A for conveying a card CA introduced from the first introducing opening 21, a second conveyer 40B for conveying a document SH introduced from the second introducing opening 11, a first motor which is used to transmit power to the first conveyer 40A, and a second motor which is used to transmit power to the second conveyer 40B, and the CPU 50 may stop driving of the second motor in the suppressing process, thereby stopping driving of the second conveyer 40B.

Figure 9:
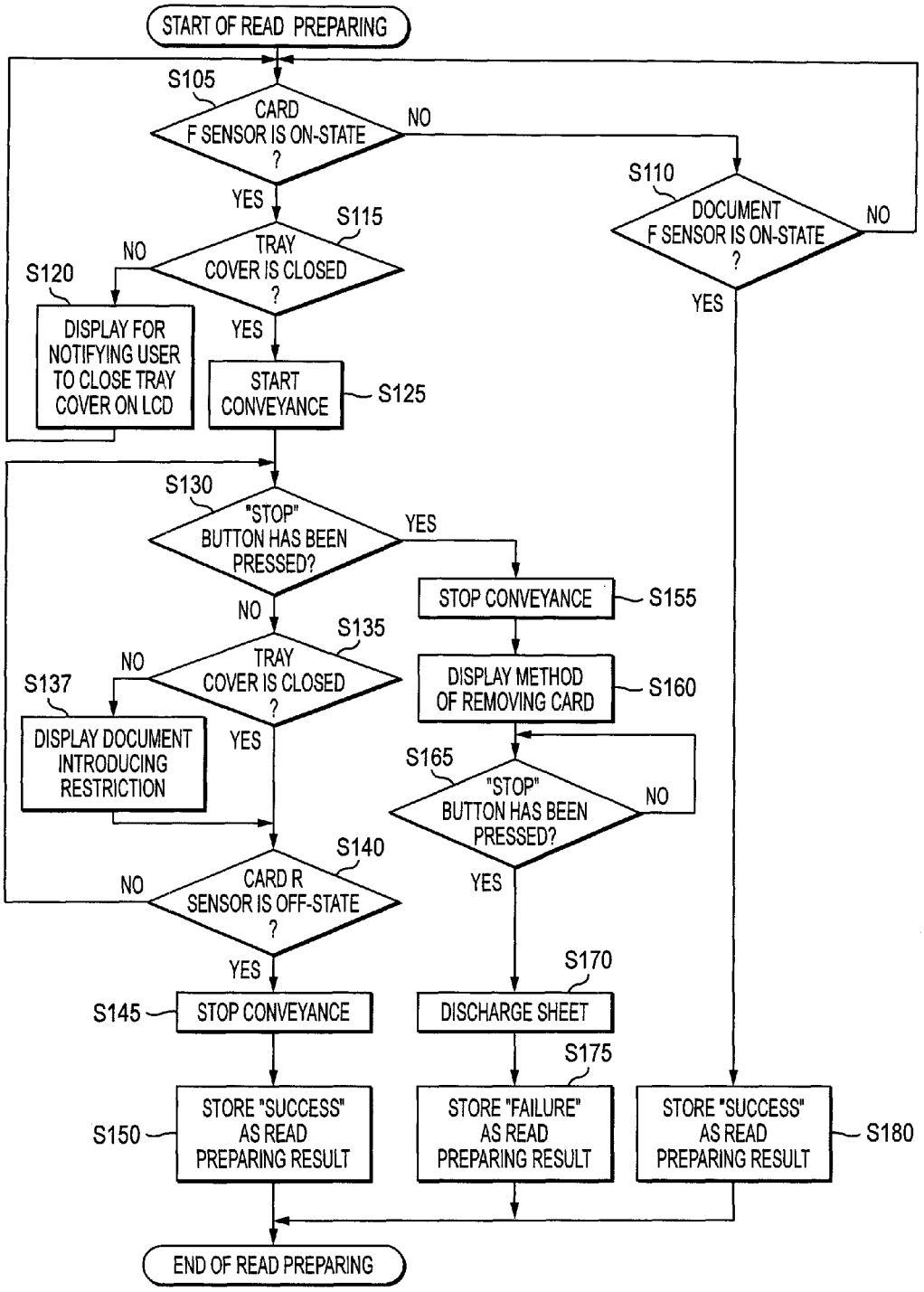
FIG. 9 is a flow chart of a read preparing process which is performed in the main process.
Figure 12:
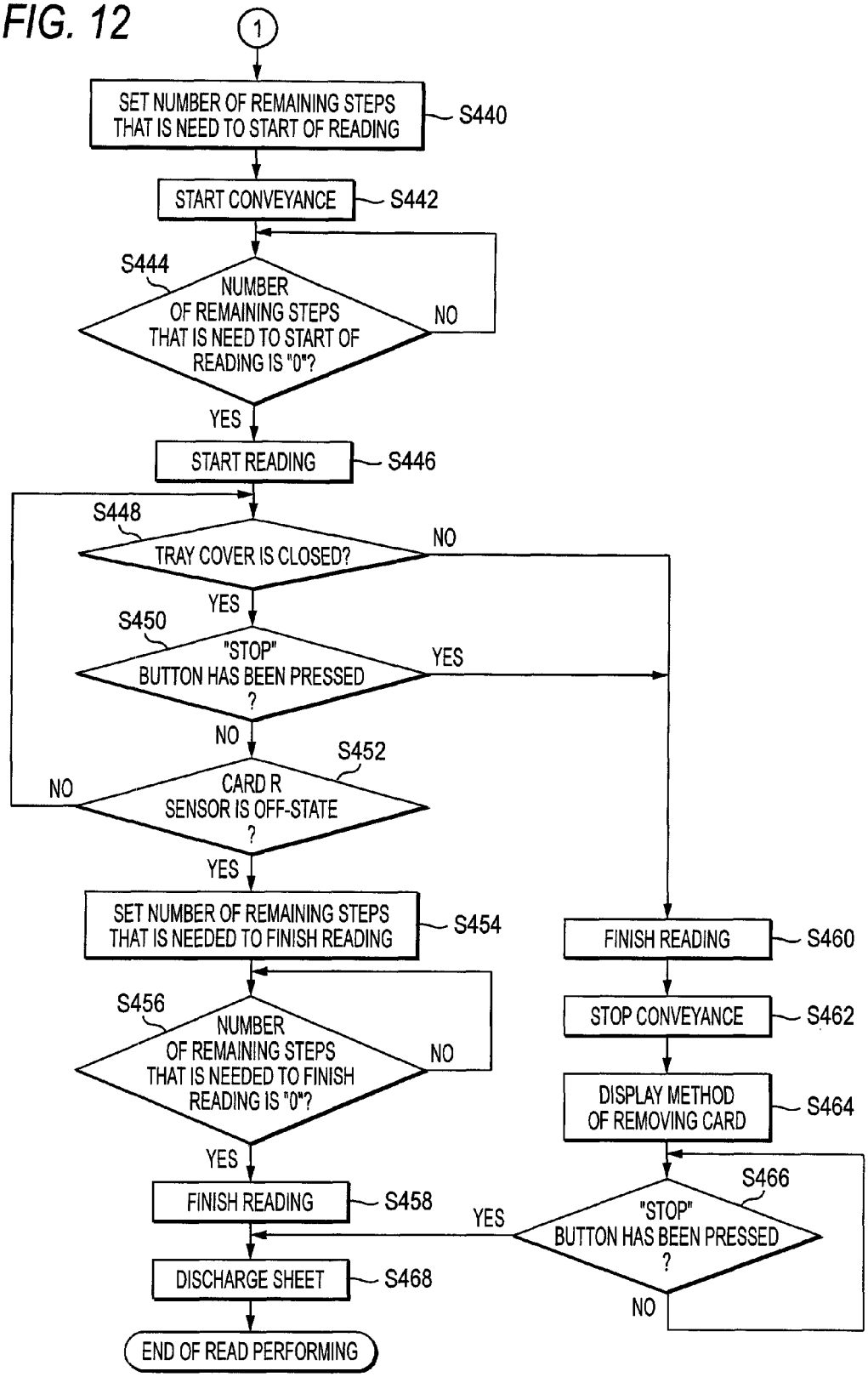
FIG. 12 is a flow chart of a card reading process which is performed in the main process.

Specifically, for example, in a case of "NO" in Step S135 of FIG. 9, and in a case of "NO" in Step S448 of FIG. 12, the CPU 50 may stop driving of the second conveyer 40B (an example of the suppressing process). Even in this case, it is possible to maintain the conveyance of the card CA while surely suppressing a document SH introduced in the second introducing opening 11 from being conveyed.

(2) In the above described illustrative embodiment, the card F sensor 62 is provided and the conveyer 40 is driven based on detection of a card CA by the card F sensor 62. However, this disclosure is not limited thereto. For example, the card F sensor 62 may not be provided. In this case, the conveyer 40 may be driven when receiving a drive instruction for driving the conveyer, that is, when receiving of a read instruction request from the user and when detecting of the closed state of the cover.

(3) In the above described illustrative embodiment, an example, in which the first conveyance path 20 joins the second conveyance path 10 on the way, has been described. However, this disclosure is not limited thereto. This disclosure can be applied to a sheet conveying device having a configuration in which the first conveyance path 20 does not join the second conveyance path 10 on the way. In this configuration, for example, only one reading unit may be provided, and the reading unit may be moved to a corresponding conveyance path and read the sheet when one of the sensors for detecting introducing of sheets from introducing parts corresponding to the conveyance paths detects introducing of a sheet. In a sheet conveying device having the above described configuration, when both of the sensors are turned on, a problem, in which it is impossible to determine that the reading unit should be moved to which of the conveyance paths, may occur. However, according to the configuration of this disclosure, when the open/closed position sensor (the cover sensor) 60 detects the closed state of the cover 36, the driving process of driving the conveyer 40 is performed. Therefore, it is possible to suppress that problem. That is, in a configuration having two introducing parts, it is possible to maintain convenience while suppressing inconvenience due to simultaneous conveyance of a plurality of sheets.

(4) In the above described illustrative embodiment, as an example of the controller, the CPU 50 has been described. However, this disclosure is not limited thereto. For example, the controller may be configured by a plurality of circuits including an ASIC, or may be configured by a CPU and other separate circuits.

What is claimed is:

1. A sheet conveying device comprising:

a conveyer configured to convey a sheet;

a first introducing part into which a sheet is introduced toward the conveyer;

a second introducing part into which a sheet is introduced toward the conveyer, wherein the second introducing part is different from the first introducing part;

a cover configured to be displaced between an open state, in which the second introducing part is opened, and a closed state, in which the second introducing part is covered, in a state where the first introducing part is opened;

a cover sensor that detects the open-and-closed state of the cover; and a controller, wherein when the cover sensor detects the closed state of the cover, the controller performs a driving process of driving the conveyer.

2. The sheet conveying device according to claim 1, wherein the controller performs a receiving process of receiving a drive instruction to drive the conveyer, and wherein, in a case where the cover sensor detects the closed state of the cover when the drive instruction is received in the receiving process, the controller drives the conveyer in the driving process.

3. The sheet conveying device according to claim 2, further comprising:

a sheet sensor configured to detect a sheet which is introduced from the first introducing part, wherein the controller receives a detection signal, which is generated by the sheet sensor when the sheet sensor detects a sheet, as the drive instruction in the receiving process.

4. The sheet conveying device according to claim 1, further comprising:

a first conveyance path configured to convey a sheet from the first introducing part; and a second conveyance path configured to convey a sheet from the second introducing part and join the first conveyance path.

5. The sheet conveying device according to claim 4, wherein, in a case where the cover sensor detects the open state of the cover while the conveyer is being driven in the driving process, the controller performs a stopping process of stopping the driving of the conveyer.

6. The sheet conveying device according to claim 1, wherein, in a case where the cover sensor detects the open state of the cover while the conveyer is being driven by the driving process, the controller performs a suppressing process of suppressing introducing of a sheet from the second introducing part.

7. The sheet conveying device according to claim 6, further comprising a notifying part, wherein in the suppressing process, the controller controls the notifying part to notify a state in which the introducing of a sheet of from the second introducing part is suppressed.

8. The sheet conveying device according to claim 7, wherein the conveyer includes:

a first conveyer configured to convey a sheet introduced from the first introducing part;

a second conveyer configured to convey a sheet introduced from the second introducing part; and a motor that is commonly used to transmit power to the first conveyer and the second conveyer.

9. The sheet conveying device according to claim 6, wherein the conveyer includes:

a first conveyer configured to convey a sheet introduced from the first introducing part;

a second conveyer configured to convey a sheet introduced from the second introducing part;

a first motor which is used to transmit power to the first conveyer; and a second motor that is used to transmit power to the second conveyer, wherein in the suppressing process, the controller stops driving of the second motor to stop driving of the second conveyer.

10. The sheet conveying device according to claim 4, further comprising:

a discharging part that is commonly used to discharge a sheet introduced from the first introducing part and a sheet introduced from the second introducing part, wherein the first conveyance path is a conveyance path that linearly connects the first introducing part and the discharging part, and wherein the second conveyance path is a conveyance path that is bent connects the second introducing part and the discharging part.

11. An image processing apparatus comprising:

a conveyer configured to convey a sheet;

a first introducing part into which a sheet is introduced toward the conveyer;

a second introducing part into which a sheet is introduced toward the conveyer, wherein the second introducing part is different from the first introducing part;

a cover configured to be displaced between an open state, in which the second introducing part is opened, and a closed state, in which the second introducing part is covered, in a state where the first introducing part is opened;

a cover sensor that detects the open-and-closed state of the cover; and a controller, wherein when the cover sensor detects the closed state of the cover, the controller performs a driving process of driving the conveyer; and an image processor that processes image data using a sheet conveyed by the conveyer.

12. The image processing apparatus according to claim 11, wherein the controller performs a receiving process of receiving a drive instruction for driving the conveyer, and wherein in the receiving process, the controller receives the drive instruction as an instruction to start processing of the image processor on image data.

* * * * *